US007885560B2

(12) United States Patent
Murayama

(10) Patent No.: US 7,885,560 B2
(45) Date of Patent: Feb. 8, 2011

(54) IMAGE-FORMING DEVICE WITH CORRECTION MECHANISM

(75) Inventor: Kentaro Murayama, Kasugai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 76 days.

(21) Appl. No.: 12/392,532

(22) Filed: Feb. 25, 2009

(65) Prior Publication Data

US 2009/0220263 A1 Sep. 3, 2009

(30) Foreign Application Priority Data

Feb. 29, 2008 (JP) ..... 2008-050262
Feb. 16, 2009 (JP) ..... 2009-032605

(51) Int. Cl.
*G03G 15/01* (2006.01)

(52) U.S. Cl. ..... 399/49; 399/43; 399/72

(58) Field of Classification Search ..... 399/49, 399/72, 162, 302, 303, 308, 43, 9
See application file for complete search history.

(56) References Cited

U.S. PATENT DOCUMENTS

| | | | | |
|---|---|---|---|---|
| 7,027,139 | B2 * | 4/2006 | Ogihara et al. | 399/49 X |
| 7,260,336 | B2 * | 8/2007 | Shimura et al. | 399/49 |
| 2005/0163519 | A1 * | 7/2005 | Takahashi | 399/49 |
| 2007/0019976 | A1 * | 1/2007 | Watanabe et al. | 399/49 |
| 2008/0145089 | A1 * | 6/2008 | Takahashi | 399/74 |

FOREIGN PATENT DOCUMENTS

| | | |
|---|---|---|
| JP | 5-80625 | 4/1993 |
| JP | 9-152796 | 6/1997 |
| JP | 10-333443 | 12/1998 |
| JP | 2002-108165 | 4/2002 |
| JP | 2003-167406 | 6/2003 |
| JP | 2005-10450 | 1/2005 |

OTHER PUBLICATIONS

Japanese Official Action dated Aug. 17, 2010.

* cited by examiner

*Primary Examiner*—Sophia S Chen
(74) *Attorney, Agent, or Firm*—Scully, Scott, Murphy & Presser, PC

(57) ABSTRACT

A patch mark-forming unit forms a first patch mark at a first density on a surface. A light emitting unit emits an incident light onto the surface moving. The incident light reflected by the surface is divided into a mirror-reflected light and a diffusion-reflected light on the surface. A first detecting unit detects an amount of the diffusion-reflected light. The patch mark forming unit reforms a second patch mark at a second density weaker than the first density if the amount detected by the first detecting unit is larger than a threshold. A second detecting unit detects an amount of the mirror-reflected light reflected by the surface on which the second patch mark has been reformed. A position calculating unit calculates, based on the amount detected by the second detecting unit, a position at which an image should be formed. An image-forming unit forms an image at the position.

11 Claims, 9 Drawing Sheets

300Y
33
300M
301

POTENTIAL OF SECOND SENSOR
THRESHOLD R2
RB2
RB2_max
0
GND LEVEL

POTENTIAL OF FIRST SENSOR
THRESHOLD R1
0
GND LEVEL

IMAGE-FORMING DEVICE WITH CORRECTION MECHANISM

CROSS REFERENCE TO RELATED APPLICATION

This application claims priority from Japanese Patent Application No. 2008-050262 filed Feb. 29, 2008 and No. 2009-32605 filed Feb. 16, 2009. The entire content of each of these priority applications is incorporated herein by reference.

TECHNICAL FIELD

The present invention relates to an image-forming device capable of correcting displacements of images.

BACKGROUND

Conventional color image-forming device forms correction patch marks of various colors on a rotating member such as a conveying belt, and detects the positions of the correction patch marks to correct the density of each color image and the displacement of different-color images. In such conventional image-forming device, the positions of the correction patch marks are detected by detecting the infrared beam reflected by the rotating member. Further, Japanese Patent Application Publication No. H09-152796 discloses an image-forming device that changes transfer voltage between when forming the correction patch marks and when forming images on a recording medium such as a paper sheet, so that developer is transferred to each object at highest possible efficiency.

SUMMARY

However, the image-forming device disclosed in Japanese Patent Application Publication No. H09-152796 does not set the appropriate transfer voltage of the correction patch marks in view of the influence of the diffusion-reflected light. As the density of the developer other than black developer increases, the diffusion-reflected light can increase. Due to the increased diffusion-reflected light, the image-forming device disclosed in Japanese Patent Application Publication No. H09-152796 cannot detect the densities of the correction patch marks at high accuracy. Thus, the displacements of images cannot be appropriately corrected.

In view of the above-described drawbacks, it is an objective of the present invention to provide an image-forming device that can suppress the influence of diffusion-reflected light that occurs when detecting the correction patch marks, in order to appropriately correct the displacements of images.

In order to attain the above and other objects, the present invention provides an image-forming device including a moving member having a surface movable, a patch mark-forming unit, a light emitting unit, a first detecting unit, a density controlling unit, a second detecting unit, a position calculating unit, and an image-forming unit. The patch mark-forming unit forms a first patch mark at a first density on the surface. The light emitting unit emits an incident light onto the surface moving, at an incident angle for the surface. The incident light reflected by the surface is divided into a mirror-reflected light and a diffusion-reflected light on the surface. The mirror-reflected light is reflected by the surface at a reflected angle equal to the incident angle. The first detecting unit detects an amount of the diffusion-reflected light. The density controlling unit controls the patch mark forming unit to reform a second patch mark at a second density weaker than the first density if the amount detected by the first detecting unit is larger than a threshold. The second detecting unit detects an amount of the mirror-reflected light reflected by the surface on which the second patch mark has been reformed. The position calculating unit calculates, based on the amount detected by the second detecting unit, a position on the surface at which an image should be formed. The image-forming unit forms an image at the position.

Another aspect of the present invention provides an image displacement correcting method. The method includes: forming a first patch mark at a first density on a surface; emitting an incident light onto the surface moving, at an incident angle for the surface, the incident light reflected by the surface being divided into a mirror-reflected light and a diffusion-reflected light on the surface, the mirror-reflected light being reflected by the surface at a reflected angle equal to the incident angle; detecting an amount of the diffusion-reflected light; reforming a second patch mark at a second density weaker than the first density if the detected amount of the diffusion-reflected light is larger than a threshold; detecting an amount of the mirror-reflected light reflected by the surface on which the second patch mark has been reformed; calculating, based on the detected amount of the mirror-reflected light, a position on the surface at which an image should be formed; and forming an image at the position.

BRIEF DESCRIPTION OF THE DRAWINGS

The particular features and advantages of the invention as well as other objects will become apparent from the following description taken in connection with the accompanying drawings, in which.

DETAILED DESCRIPTION

An embodiment of the present invention will be described with reference to the accompanying drawings. In the embodiment described below, the present invention is applied to a laser printer connected to a computer for use.

1. Outer Appearance of Laser Printer

Figure 1:
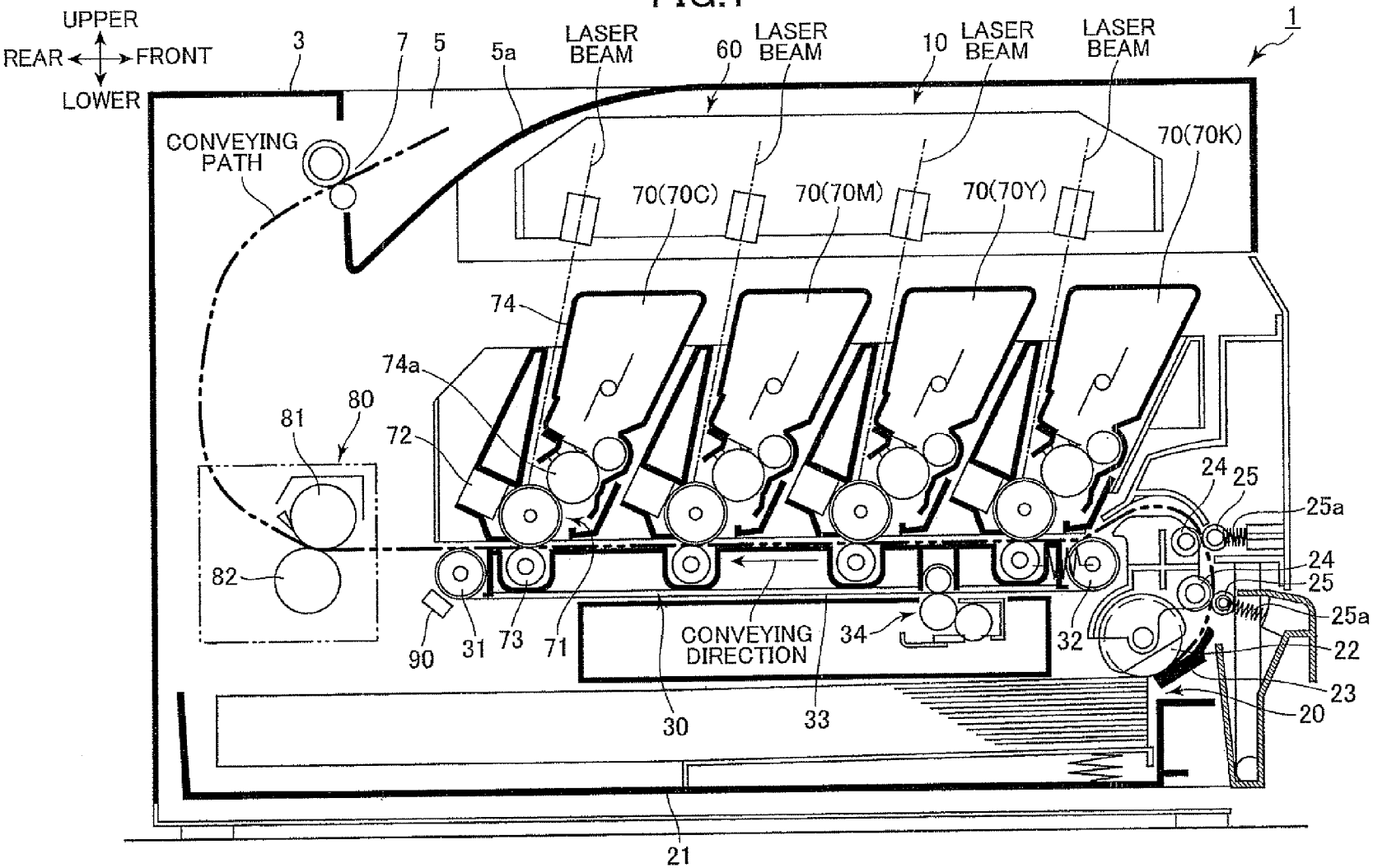
FIG. 1 is a sectional side view schematically showing the configuration of a laser printer according to the present invention.

FIG. 1 is a sectional side view schematically showing the configuration of the laser printer 1. The laser printer 1 is installed with the top turned upward in the direction of gravity, as is illustrated in FIG. 1. In most cases, the laser printer 1 is positioned, with the right side in FIG. 1 set toward the user. The laser printer 1 has a housing 3, which is shaped like a box (cube). On the top of the housing 3, a discharge tray 5 is provided to hold recording sheets (recording media), such as paper sheets or OHP sheets that have been discharged from the housing 3 after data has been printed an them.

In the present embodiment, a frame member (not shown) made of metal or resin is provided in the inside of housing 3. A process cartridge 70 described later and a fixing unit 80 are detachably mounted on the frame member.

The discharge tray 5 has an inclining surface 5*a* that is inclined downwardly from the front toward the rear of the upper surface of the housing 3. At the rear end of the inclining surface 5*a*, a discharge unit 7 is provided to discharge any recording sheet on which data has been printed.

2. Internal Mechanical Configuration of Laser Printer

The laser printer 1 has an image-forming unit 10 for forming images on recording sheets, a feeding unit 20 for feeding recording sheets to the image-forming unit 10, and a conveying mechanism 30 for conveying a recording sheet.

The laser printer 1 has a print density sensor 90 for detecting correction patch marks formed on a conveying belt 33 described later. A recording sheet on which an image is formed by the image-forming unit 10 is turned upward in an discharging chute (not shown), and then discharged from the discharge unit 7 onto the discharge tray 5.

2.1. Configuration of Feeder

The feeding unit 20 includes a feeding tray 21, a feeding roller 22, and a separation pad 23. The feeding tray 21 is provided in the lowermost part of the housing 3. The feeding roller 22 is located above the front edge of the feeding tray 21 to feed a recording sheet from the feeding tray 21 to the image-forming unit 10. The separation pad 23 is positioned on a part opposing to the feeding roller 22 to apply a prescribed feeding resistance to a topmost recording sheet, thereby separating the topmost sheet from any other recording sheet.

On the feeding tray 21, the recording sheet is U-turned in the front part of the housing 3 and conveyed to the image-forming unit 10 arranged in a middle part of the housing 3. A sheet-conveying path extends from the feeding tray 21 to the discharge tray 5. A conveying roller 24 is arranged at one part of the sheet-conveying path, where the sheet is U-turned. The conveying roller 24 feeds the sheet toward the image-forming unit 10.

A pressing roller 25 is arranged at a part opposing to the conveying roller 24 across the recording sheet to press the recording sheet onto the conveying roller 24. Specifically, an elastic member such as a coil spring 25*a* biases the pressing roller 25 toward the conveying roller 24.

2.2. Configuration of Conveying Mechanism

The conveying mechanism 30 includes a driving roller 31, a driven roller 32, and a conveying belt 33. The driving roller 31 rotates as the image-forming unit 10 operates. The driven roller 32 is rotatably provided spaced apart from the driving roller 31. The conveying belt 33 is wrapped around the driving roller 31 and the driven roller 32. The recording sheet conveyed from the feeding tray 21 to the conveying belt 33 is conveyed to the four process cartridges 70K, 70Y, 70M and 70C, from each cartridge to the next one. The conveying mechanism 30, that is, the driving roller 31, the driven roller 32, and the conveying belt 33 are detachable integrally by opening the upper cover of the housing 3. Below the conveying belt 33, a belt cleaner 34 described later is arranged to clean the correction patch marks from the surface of the conveying belt 33.

2.3. Configuration of Image-Forming Unit

The image-forming unit 10 includes a scanner unit 60, a process cartridge 70, and a fixing unit 80. The image-forming unit 10 of this embodiment is a direct tandem type that can accomplish color printing. The process cartridge 70 has the process cartridges 70K, 70Y, 70M and 70C containing black toner, yellow toner, magenta toner and cyan toner, respectively. The process cartridges 70K, 70Y, 70M and 70C are arranged in the mentioned order from upstream side in a conveying direction of the sheets. The process cartridges 70K, 70Y, 70M and 70C have same structures with each other, except for colors of the toners (developers) Hereinafter, the four process cartridges 70K, 70Y, 70M and 70C will be generally referred to as the process cartridge 70.

The scanner unit 60 includes a laser beam source, a polygon mirror, an fθ lens, and a reflector to form an electrostatic latent image on each photosensitive drum 71 of the respective process cartridges 70K, 70Y, 70M and 70C.

The process cartridge 70 is detachably mounted on the housing 3 below the scanner unit 60. The process cartridge 70 has the photosensitive drum 71, a charger 72, a transfer roller 73, and a developer cartridge 74 having a developing roller 74*a*.

The fixing unit 80 is arranged downstream of the photosensitive drum 71 in the conveying direction. The fixing unit 80 includes a heating roller 81 and a pressing roller 82 opposing to the heating roller 81 across the recording sheet. The heating roller 81 feeds a recording sheet forward, while heating the toner applied to the sheet. The pressing roller 82 presses the sheet onto the heating roller 81. Thus, an image formed on the recording sheet is fixed.

As the photosensitive drum 71 rotates, the surface thereof is positively and uniformly charged by the charger 72. The surface is then scanned at high speed with the laser beam emitted from the scanner unit 60. The part of the surface exposed to the laser beam therefore has a lower potential than the part not exposed. An electrostatic latent image that corresponds to an image to be formed on the recording sheet is therefore formed on the surface of the photosensitive drum 71.

Next, a development bias is applied to the developing roller 74*a*, while rotating the developing roller 74*a* provided in the process cartridge 70. The toner positively charged is supplied from the developing roller 74*a* to the surface of the photosensitive drum 71 positively and uniformly charged, which is exposed to the laser beam and has a lower potential. The electrostatic latent image on the photosensitive drum 71 is thereby changed to a visible image. That is, inverse development is achieved, forming a toner image on the surface of the photosensitive drum 71.

Thereafter, the toner image is transferred from the surface of the photosensitive drum 71 to a recording sheet, because of the transfer bias applied to the transfer roller 73. The recording sheet on which the toner image is formed is conveyed to the fixing unit 80. The fixing unit 80 heats the recording sheet, fixing the toner to the recording sheet. The image is thereby formed (printed) on the recording sheet.

2.4. Configuration of Print Density Sensor

Figure 2:
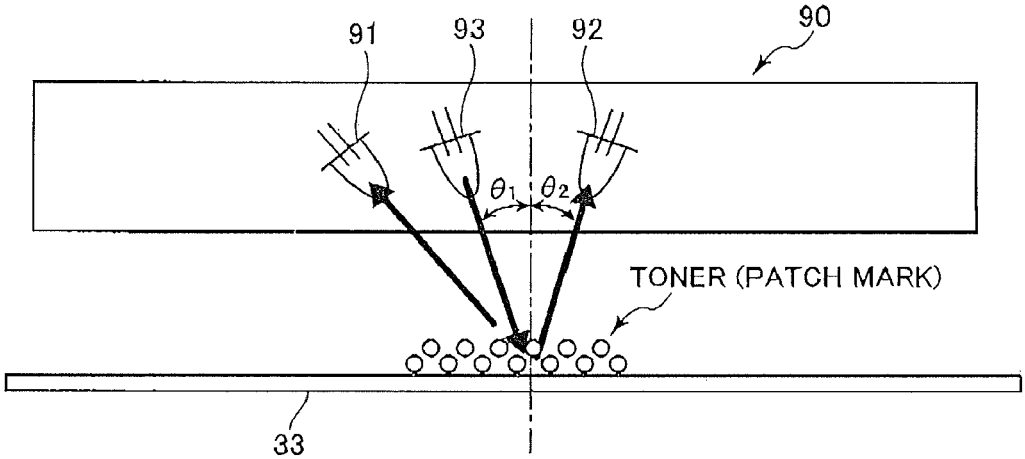
FIG. 2 is a diagram schematically illustrating the configuration of a print density sensor incorporated in the laser printer.

FIG. 2 is a diagram schematically illustrating the configuration of the print density sensor 90. As shown in FIG. 2, the print density sensor 90 includes an infrared light-emitting diode 93, a first sensor 91, and a second sensor 92. The infrared light-emitting diode 93 emits an infrared beam to the conveying belt 33 at an incidence angle θ1. The second sensor 92 detects the amount (intensity) of the infrared beam reflected by the conveying belt 33 at a reflection angle θ2 equal to the incidence angle θ1. The first sensor 91 detects the amount (intensity) of the infrared beam reflected by the conveying belt 33 at a reflection angle different from the incidence angle θ1.

The conveying belt 33 is made from a film in which carbon is dispersed. Therefore, the conveying belt 33 has electrical property for transferring toner, and the surface of the conveying belt 33 appears as black and is highly glossy. Since the surface of the conveying belt 33 is highly glossy, the conveying belt 33 causes mush mirror-reflected light. Since the surface of the conveying belt 33 appears as black, the conveying belt 33 can absorb infrared light and scarcely cause the diffusion-reflected light. When the diffusion-reflected light does not occur, the infrared beam is reflected only at the reflection angle θ2 as the mirror-reflected light. Hence, when correction patch marks are not formed on the conveying belt 33, the second sensor 92 detects strong reflected light, whereas the first sensor 91 scarcely detects reflected light.

On the other hand, when correction patch marks are formed on the conveying belt 33, the infrared beam reflected by the correction patch marks is divided into the mirror-reflected light and the diffusion-reflected light. Therefore, the first sensor 91 detects the reflected light reflected at the reflection angle different from the incidence angle θ1, whereas the second sensor 92 detects decreased reflected light.

In this embodiment, the correction patch marks are monochrome images, and black toner, cyan toner, magenta toner and yellow toner are transferred to the conveying belt 33, forming black, cyan, magenta and yellow correction patch marks, each shaped like a strip.

Figure 3:
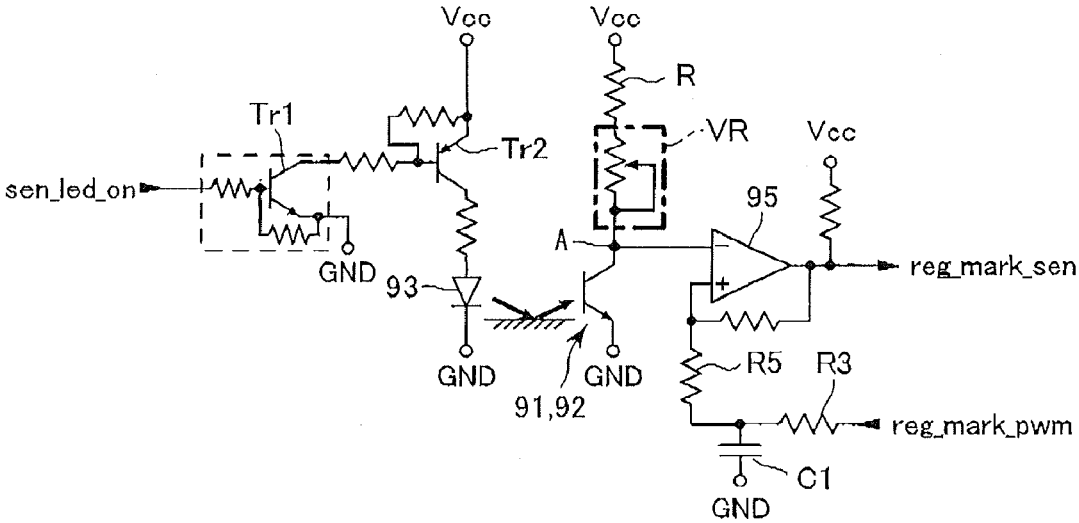
FIG. 3 is a circuit diagram showing the electrical configuration of the print density sensor.

FIG. 3 is a circuit diagram showing the electrical configuration of the print density sensor 90. Note that the second sensor 92 and the first sensor 91 are identical in electrical configuration. Therefore, one of the electrical configurations thereof is shown in FIG. 3.

As shown in FIG. 3, transistors Tr1 and Tr2 that compose an amplifier are turned on or off in response to a signal sen_led_on inputtted from a control unit 100 described later. When 3.3 V is applied from a DC power supply Vcc to the infrared light-emitting diode 93 through the amplifier circuit, the infrared light-emitting diode 93 emits the infrared beam. The second sensor 92 and the first sensor 91 are phototransistors, which are connected to a DC power supply Vcc of 3.3V via a variable resistor VR and a resistor R, so that the electric current corresponding to the amount of received light passes through the variable resistor VR and the resistor R1. Therefore, as the amount of received light increases, voltage drops at the resistor R1 and variable resistor VR, and the potential of the point A in FIG. 3 decreases. This potential difference is input to a comparator 95, and the comparator 95 compares the potential difference with a signal reg_mark_pwm input from the control unit 100.

Signal reg_mark_pwm is a PWM signal. The signal is smoothed by a smoothing circuit composed of a resistor R3 and a capacitor C1. The signal thus smoothed is inputted into the comparator 95 via a resistor R5. Therefore, if the signal reg_mark_pwm corresponding to a prescribed threshold value is inputted into the comparator 95, the comparator 95 can output a detection signal reg_mark_sen that rises to H level when the amount of received light the second sensor 92 (first sensor 91) has received exceeds the threshold value.

3. Control System of Laser Printer

Figure 4:
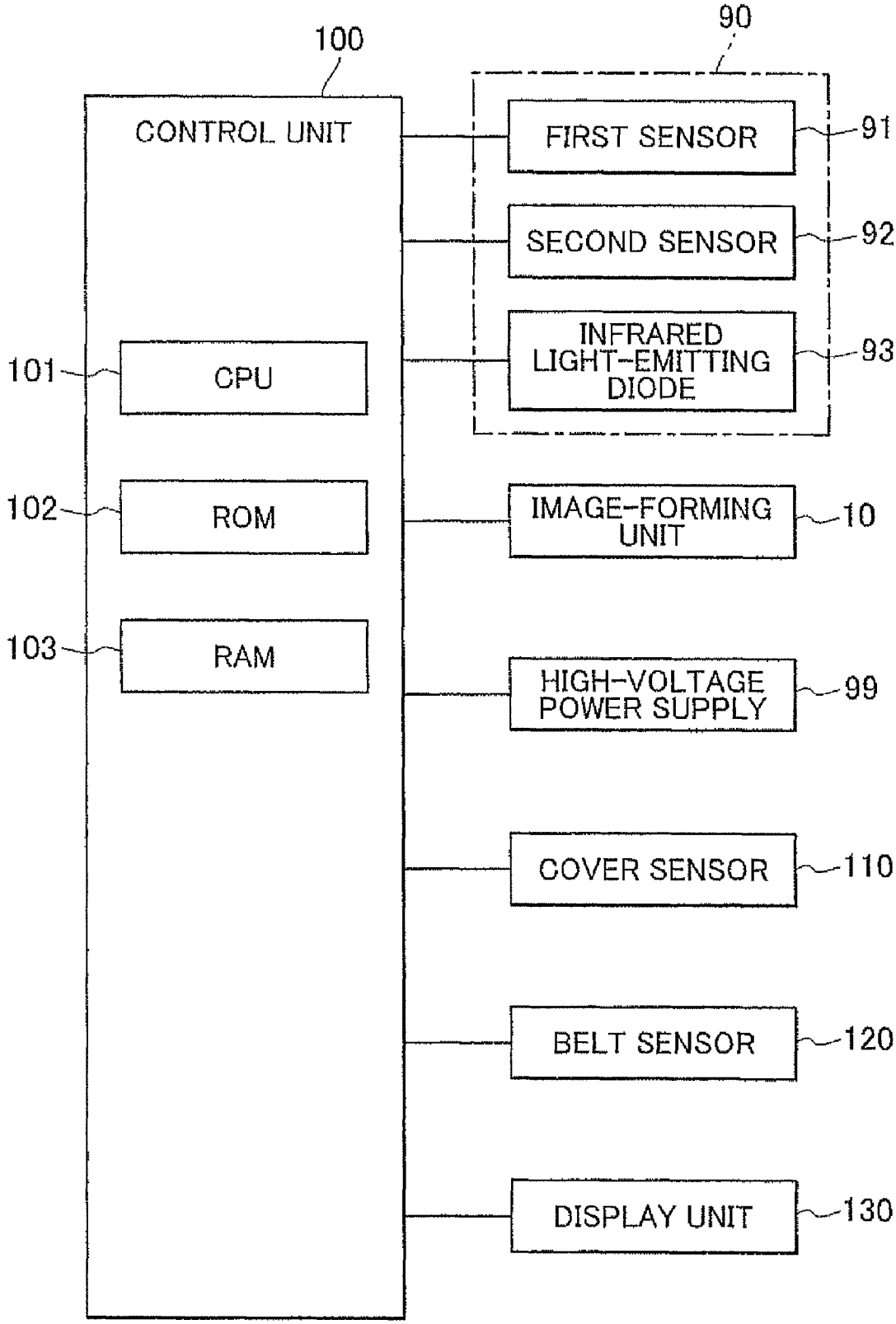
FIG. 4 is a block diagram showing the configuration of a control system of the laser printer.

FIG. 4 is a block diagram showing the configuration of the control system of the laser printer 1. As shown in FIG. 4, the second sensor 92, the first sensor 91 and the infrared light-emitting diode 93, which constitute the print density sensor 90, are connected to the control unit 100, along with the above-mentioned image-forming unit 10 and a high-voltage power supply 99. The high-voltage power supply 99 applies a development bias to the developing roller 74*a*. The control unit 100 is composed mainly of a microprocessor that has a CPU 101, a ROM 102 and a RAM 103. The control unit 100 controls the image-forming unit 10, the high-voltage power supply 99, etc., as will be described later, in accordance with programs stored in the ROM 102. A cover sensor 110, a belt sensor 120, and a display unit 130, all being of known types, are connected to the control unit 100. The cover sensor 110 detects the open of the upper cover of the housing 3. The belt sensor 120 detects that the conveying belt 33 is mounted. The display unit 130 is provided on the surface of the housing 3.

4. Control Performed by Control System

Figure 5:
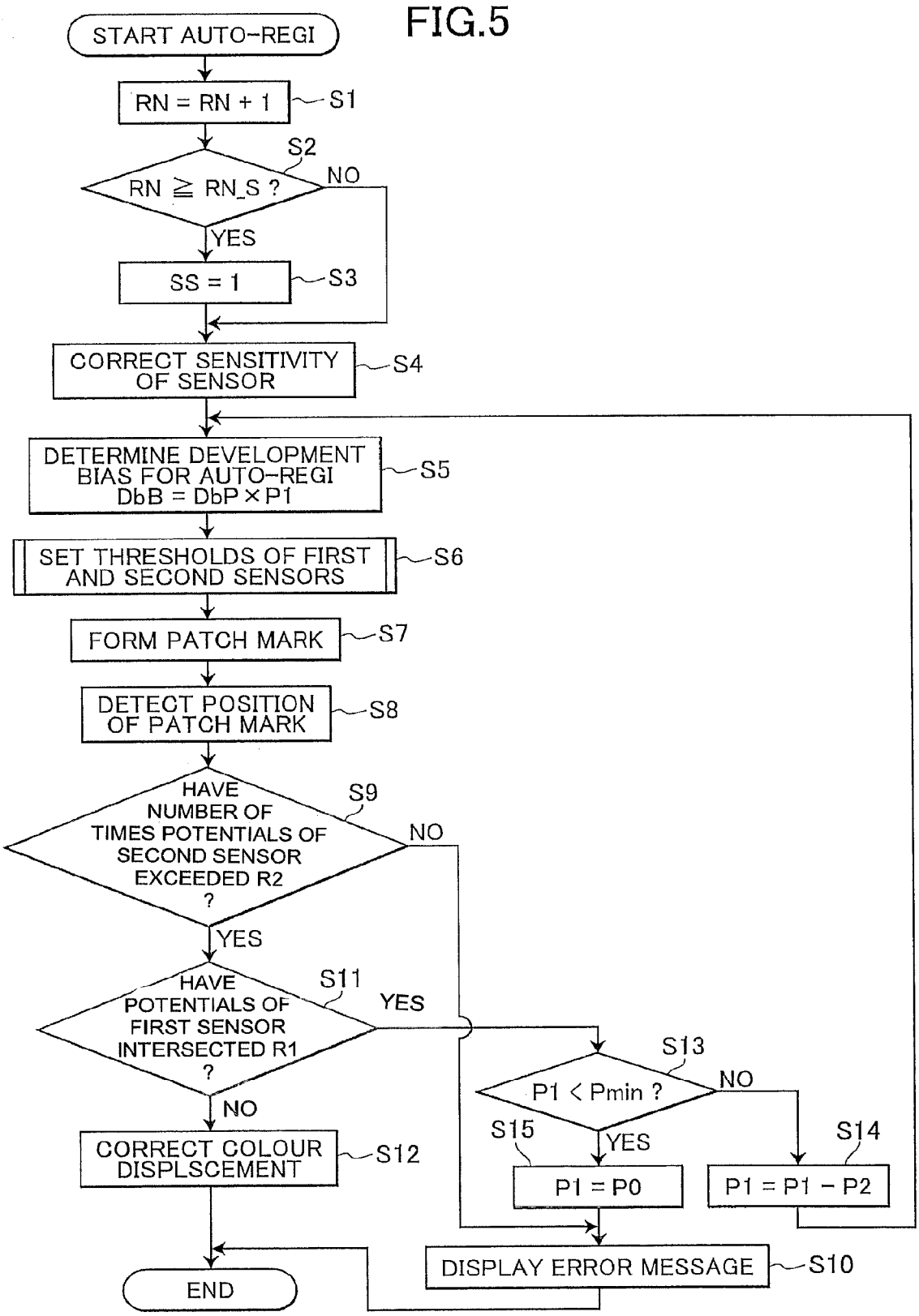
FIG. 5 is a flowchart explaining an automatic registration that the control system performs.

An automatic registration performed by the control unit 100 will be explained. FIG. 5 is a flowchart explaining the automatic registration. In the automatic registration, the correction patch marks are formed on the conveying belt 33, the positions of the correction patch marks are detected, and then the displacement of different-color images are corrected based on the detected positions of the correction patch marks. The automatic registration is started when, for example, the power switch of the laser printer 1 is turned on, as known in the art.

As shown in FIG. 5, in Step S1, the control unit 100 increments a variable RN by one. The variable RN indicates the number of times the automatic registration has been performed since threshold values have been set in Step S6 in the latest time. In other words, the variable RN is not reset even if the automatic registration is ended, unless the threshold values are set.

In Step S2, the control unit 100 determines whether or not the variable RN has exceeded a predetermined value RN_S. If RN≧RN_S (Yes in S2), in Step S3 the control unit 100 sets flag SS to 1, and then, the operation goes to Step S4. When the flag SS is 1, the threshold values are set in Step S6 described later. On the other hand, if RN<RN_S (No in S2), the operation goes to Step S4. That is, if RN<RN_S (No in S2), the threshold values are not set in Step S6 since the flag SS is not set to 1 in Step S3.

In Step S4, the control unit 100 corrects the sensitivity of the print density sensor 90 based on the surface condition of the conveying belt 33. Specifically, the control unit 100 controls the infrared light-emitting diode 93 to emit the infrared light onto the conveying belt 33 on which the correction patch mark is not formed, and sets a resistance value of the variable resistor VR so that the potentials inputted from the first and first sensors 92 and 91 to the comparator 95 are saturated. Hereinafter, these potentials will be referred to as a potential of the sensor 91 and a potential of the sensor 92.

In Step S5, the control unit 100 determines the development bias DbB for the correction patch mark by using the equation of DbE=DbP×P1. In this equation, DbP is development bias applied when forming an image on the recording sheet, and P1 is a correction coefficient. P1 is set to prescribed initial value P0 at first.

Figure 6:
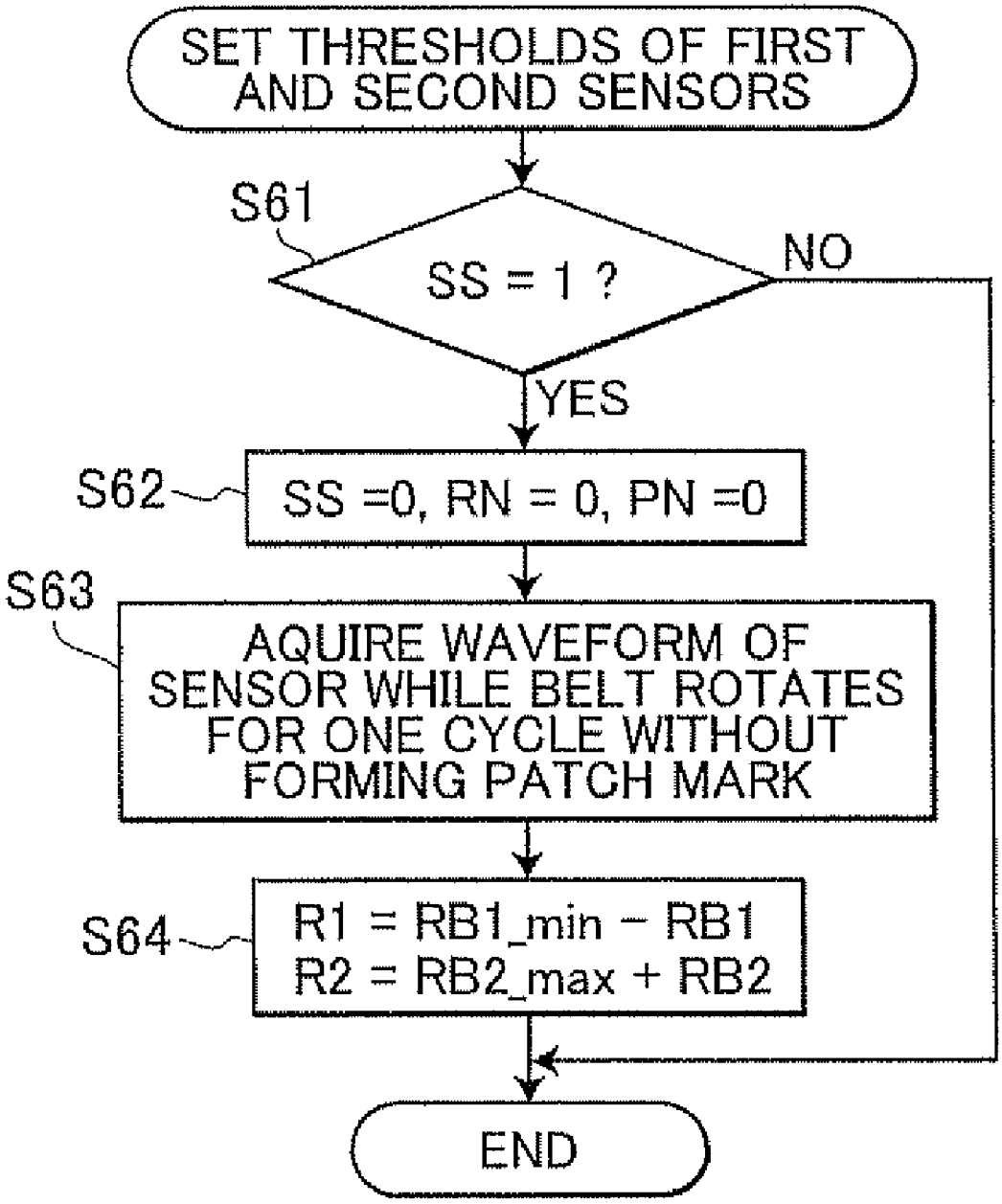
FIG. 6 is a flowchart explaining, in detail, the process of setting threshold values in first and first sensors to perform the automatic registration.

If the surface of the conveying belt 33 is rough with scratches, the amount of the infrared light detected by the first sensor 91 and the second sensor 92 are not accurate. Therefore, in Step S6, the control unit 100 sets the threshold values of the first and second sensors 91 and 92 in view of scratches of the conveying belt 33. FIG. 6 is a flowchart explaining, in detail, this process of setting threshold value R1 and threshold value R2 in Step S6.

In Step S61, the control unit 100 determines whether or not the flag SS is set to 1. If the flag SS≠1 (No in S61), the process goes to Step S7 of FIG. 5. That is, the threshold values are not set, since the flag SS is set to 0.

On the other hand, if the flag SS=1 (Yes in S61), in Step S62, the control unit 100 sets the flag SS and the variable RN to 0, and then, in Step S63, the control unit 100 controls the conveying belt 33 to rotate one turn, controlling the infrared light-emitting diode 93 to emit the infrared beam onto the conveying belt 33, without forming the correction patch marks, in order to acquire waveforms signals indicating changes of the potentials of the first sensor 91 and the second sensors 92. The potential of the first sensor 91 is identical to the potential between the first sensor 91 and the variable resistor VR in FIG. 3. The potential of the second sensor 92 is identical to the potential between the second sensor 92 and the variable resistor VR in FIG. 3.

In Step S64, the control unit 100 calculates the threshold value R1 of the first sensor 91 and the threshold value R2 of the second sensor 92, using the following equations, and the process goes to Step S7 in FIG. 5

$$R1=RB1_\mathrm{min}-RB1$$

$$R2=RB2_\mathrm{max}+RB2$$

where RB1_min is the minimum potential acquired by the first sensor 91 in Step S63, RB1 is a preset adjustment parameter, RB2_max is the maximum potential acquired by the second sensor 92 in Step S63, and RB2 is a preset adjustment parameter.

Figure 7A:
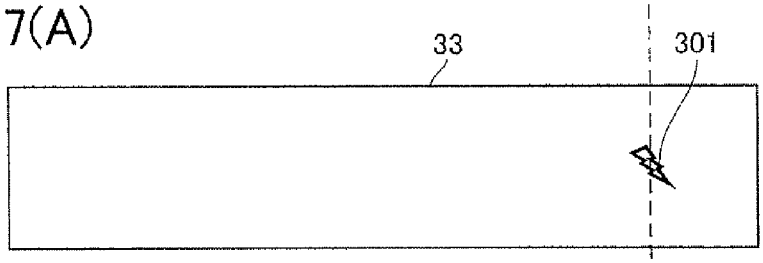
FIG. 7A is a diagram showing a conveying belt that is rough with a scratch.
Figure 7B:
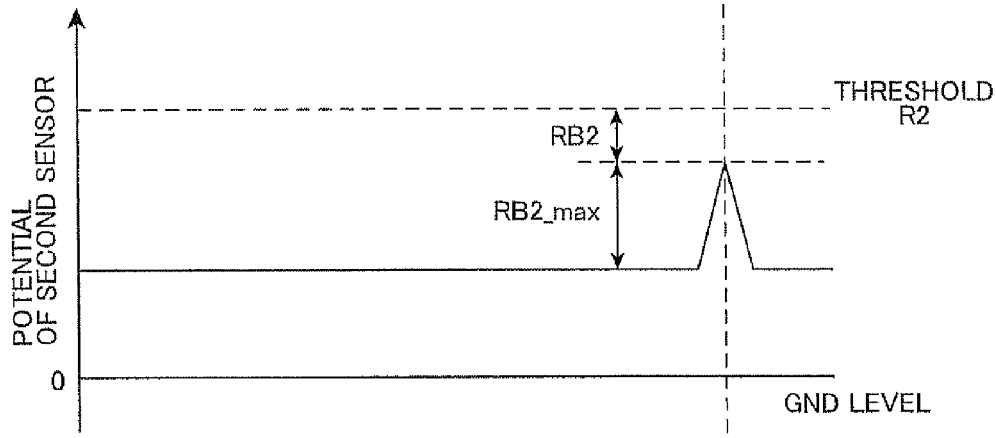
FIG. 7B is a diagram showing changes of potentials of the second sensor with respect to the infrared beam reflected by the conveying belt shown in FIG. 7A.
Figure 7C:
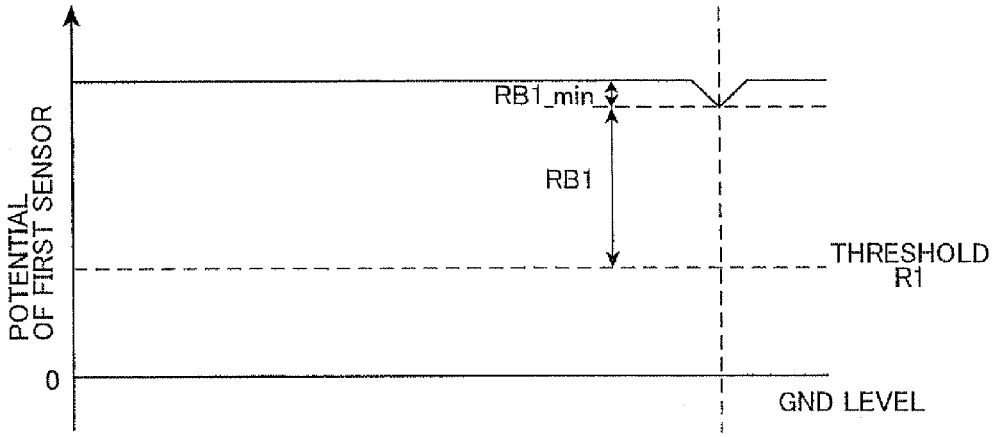
FIG. 7C is a diagram showing changes of potentials of the first sensor with respect to the infrared beam reflected by the conveying belt shown in FIG. 7A.

FIG. 7A is a diagram showing the conveying belt 33 that is rough with scratches 301. FIG. 7B is a diagram showing changes of the potentials of the second sensor 92 with respect to the infrared beam reflected by the conveying belt 33 shown in FIG. 7A. FIG. 7C is a diagram showing changes of the potentials of the first sensor 91 with respect to the infrared beam reflected by the conveying belt shown in FIG. 7A.

If the surface of the conveying belt 33 is not rough with scratches and dust, and the like, most part of the infrared beam emitted from the infrared light-emitting diode 93 is mirror-reflected on the conveying belt 33 and detected by the second sensor 92. However, if the surface of the conveying belt 33 is rough with scratches and dust, the infrared beam emitted from the infrared light-emitting diode 93 is also diffusion-reflected on scratches. Therefore, the amount of the infrared beam detected by the second sensor 92 is decreased in comparison with when the surface of the conveying belt 33 is not rough with scratches, causing the potential of the second sensor 92 increased as shown in FIG. 7B. Further, if the surface of the conveying belt 33 is rough with scratches, the amount of the infrared beam detected by the first sensor 91 is increased in comparison with when the surface of the conveying belt 33 is not rough with scratches, causing the potential of the first sensor 91 decreased as shown in FIG. 7C.

As described above, if the surface of the conveying belt 33 is rough with scratches, the diffusion-reflected light can occur even if the correction patch mark is not formed on the conveying belt 33.

Therefore, in Step S6, the control unit 100 sets the threshold values R1 and R2 in view of the changes of the potentials of the first sensor 91 and the second sensor 92 that occur due to the scratches. Specifically, the control unit 100 sets the threshold R1 to a value lower than the minimum potential corresponding to the maximum amount of the infrared beam detected by the first sensor 91, and sets the threshold value R2 to a value higher than the maximum potential corresponding to the minimum amount of the infrared beam detected by the second sensor 92.

In Step S7 of FIG. 5, the control unit 100 controls the high-voltage power supply 99 to apply the development bias DbB determined in Step S5 to the developing roller 74*a*. Thus, the image-forming unit 10 forms the correction patch marks on the conveying belt 33. In Step S8, the control unit 100 acquires the positions of the correction patch marks based on the potentials of the second sensor 92.

Figures 8A, 8B, 8C:
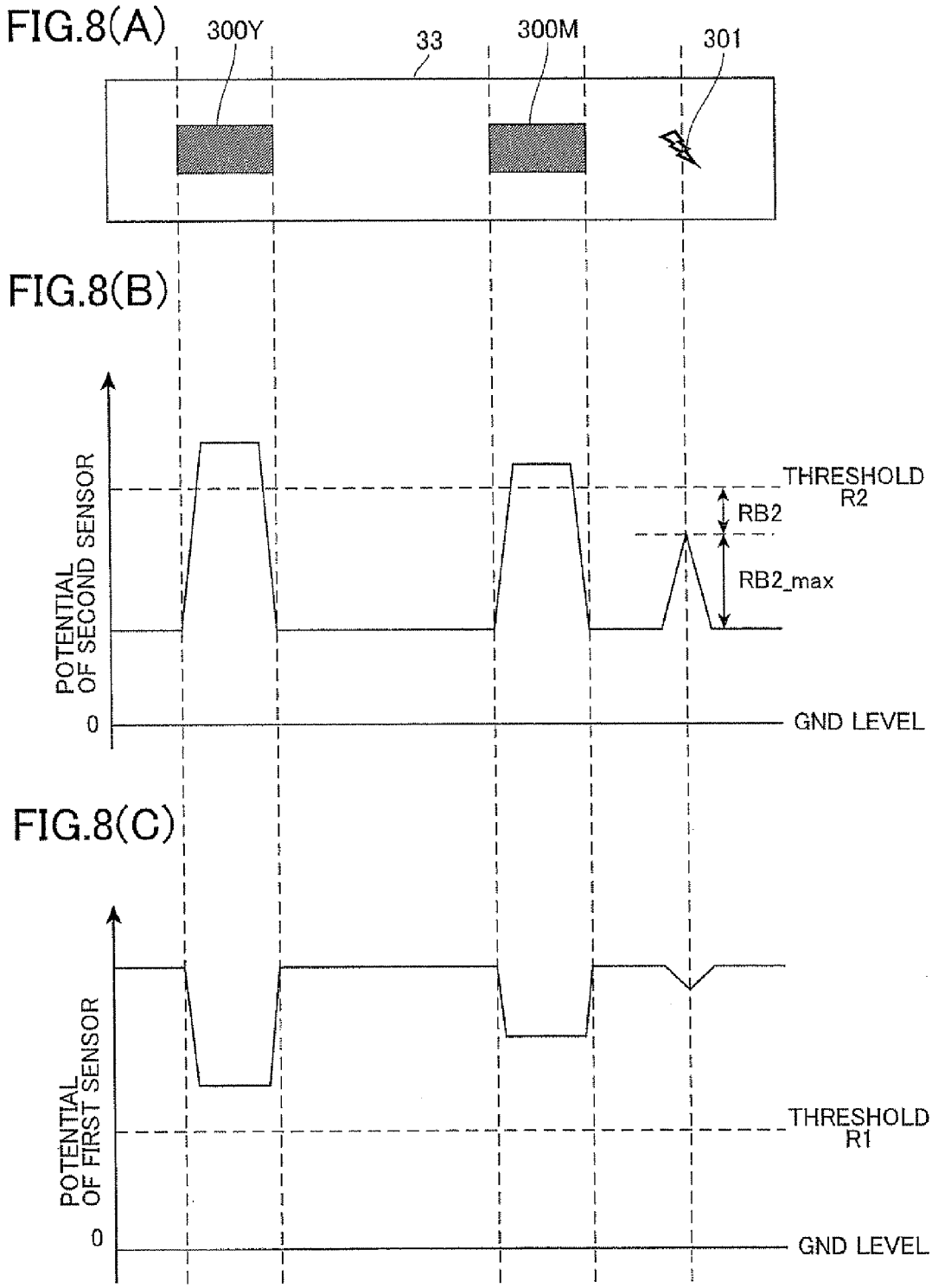
FIG. 8A is a diagram showing the conveying belt that is rough with a scratch and formed with correction patch marks.
FIG. 8B is a diagram showing changes of potentials of the second sensor with respect to the infrared beam reflected by the conveying belt shown in FIG. 8A.
FIG. 8C is a diagram showing changes of potentials of the first sensor with respect to the infrared beam reflected by the conveying belt shown in FIG. 8A.

FIG. 8A is a diagram showing the conveying belt 33 that is rough with scratches 301 and formed with correction patch marks 300Y and 300M. FIG. 8B is a diagram showing changes of the potentials of the second sensor 92 with respect to the infrared beam reflected by the conveying belt 33 shown in FIG. 8A when the density of the correction patch marks is lower than the region indicated by two-dot dashed lines in FIG. 9B described later. FIG. 8C is a diagram showing changes of the potentials of the first sensor 91 with respect to the infrared beam reflected by the conveying belt 33 shown in FIG. 8A when the density of the correction patch marks is lower than the region indicated by two-dot dashed lines in FIG. 9B described later.

The infrared beam reflected by the correction patch mark 300Y is divided into the mirror-reflected light and the diffusion-reflected light. Therefore, the amount of the infrared beam reflected by the correction patch 300Y and detected by the second sensor 92 is smaller than the amount of the infrared beam reflected by the conveying belt 33 that is not rough with scratches and detected by the second sensor 92. Thus, as shown in FIG. 8B, the potential of the second sensor 92 with respect to the infrared beam reflected by the correction patch mark 300Y is higher than the potential of the second sensor 92 with respect to the infrared beam reflected by the conveying belt 33. Above described result is also adapted to magenta and cyan patch marks.

On the other hand, the amount of the infrared beam reflected by the correction patch 300Y and detected by the first sensor 91, is greater than the amount of the infrared beam reflected by the conveying belt 33 that is not rough with scratches and detected by the first sensor 91. Therefore, as shown in FIG. 8C, the potential of the first sensor 91 with respect to the infrared beam reflected by the correction patch mark 300Y is lower than the potential of the first sensor 91 with respect to the infrared beam reflected by the conveying belt 33. Above described result is also adapted to magenta and cyan patch marks.

In Step S9, the control unit 100 determines whether or not the number of times the potentials of the second sensor 92 have exceeded the threshold value R2 set in Step S6 identical to a preset value (i.e., the number of correction patch marks).

When the conveying belt 33 is rough with scratches, the mirror-reflected light is decreased and the potential of the second sensor 92 is increased as shown in FIG. 8B. If the scratch is fairly large, the potential of the second sensor 92 with respect to the infrared beam reflected by the scratches may be higher than the potential of the second sensor 92 with respect to the infrared beam reflected by the correction patch mark 300Y. In such case, the potential of the second sensor 92 with respect to the infrared beam reflected by the correction patch mark 300Y cannot exceeds the threshold value R2. Further, when the adjustment parameter RB2 is extremely great, the potential of the second sensor 92 with respect to the infrared beam reflected by the correction patch mark 300Y cannot also exceed the threshold R2.

Therefore, if the number of times is not identical to the preset value (No in S9), in Step S10, the control unit 100 controls the display unit 130 to display an error message.

On the other hand, if the number of times is identical to the preset value (Yes in S9), in Step S11, the control unit 100 determines whether or not the potentials of the first sensor 91 have intersected the threshold value R1. If the potentials have not intersected the threshold value R1 (No in S11), in Step S12, the control unit 100 corrects the displacement of different-color images based on the positions of the correction patch marks detected by the second sensor 92 in Step S8, and the process is then terminated.

If the potentials of the first sensor 91 have intersected the threshold value R1 (Yes in S11), in Step S13, the control unit 100 determines whether or not the correction coefficient P1 used in Step S5 is smaller than prescribed Pmin that is a minimum value of the correction coefficient P1. If P1≧Pmin (No in Step S13), in Step S14, the control unit 100 subtracts a prescribed adjustment coefficient P2 from the correction coefficient P1 used in Step S5, and the process returns to Step S5. In Step S5, the control unit 100 determines the new development bias DbB by applying the new correction coefficient P1 to the equation of DbB=DbP×P1). Thus, the development bias DbB is reduced.

Figure 9A:
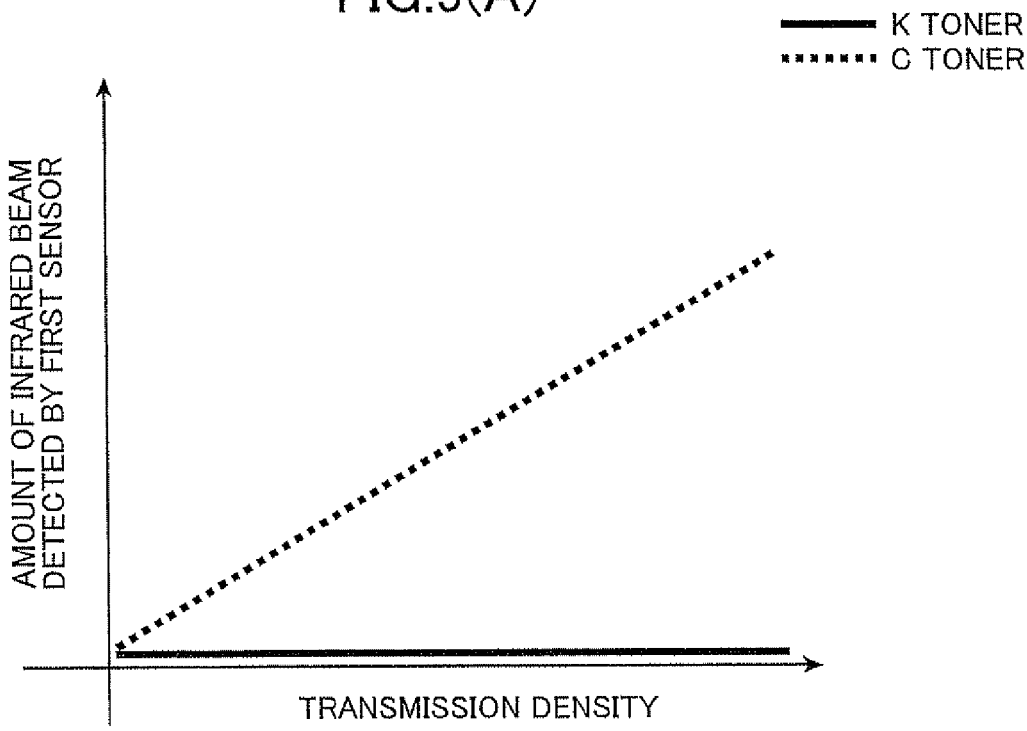
FIG. 9A is a graph explaining a relation between a transmission density of a toner that forms the correction patch marks and an amount of the infrared beam detected by the first sensor.
Figure 9B:
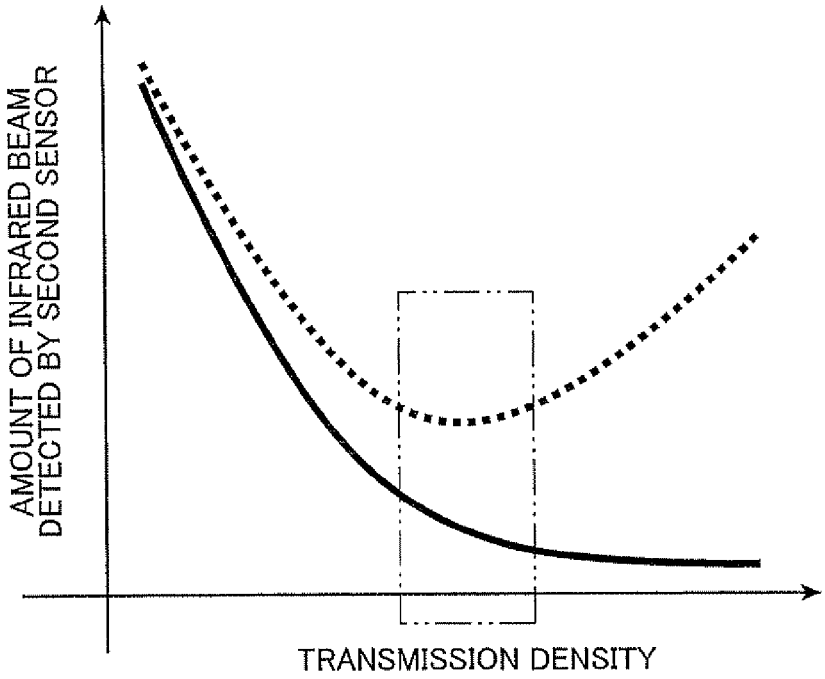
FIG. 9B is a graph explaining a relation between a transmission density of a toner that forms the correction patch marks and an amount of the infrared beam detected by the second sensor.

FIG. 9A is a graph explaining a relation between a transmission density of a toner that forms the correction patch marks and an amount of the infrared beam detected by the first sensor 91. FIG. 9B is a graph explaining a relation between a transmission density of a toner that forms the correction patch marks and an amount of the infrared beam detected by the second sensor 92.

As shown in FIG. 9A, if the color of the patch marks is black (K), no diffusion-reflected light does not occur, irrespective of the density (transmission density) of the correction patch marks. If the color of the patch marks is other than black, such as cyan (C), the diffusion-reflected light is increased in proportion to the density of the correction patch marks. Since the diffusion-reelected light is applied to the second sensor 92, together with the mirror-reflected light, the amount of the infrared beam received by the second sensor 92 changes as shown in FIG. 9B. That is, if the color of the patch marks is other than black and the density of the correction patch marks is too high, the infrared beam received by the second sensor 92 will be increased. In such case, the difference between the amount of the infrared beam received by the second sensor 92 when the correction patch marks are formed and the amount of infrared beam received by the second sensor 92 when the correction patch marks are not formed (transmission density=0) will be decreased. As the result, when the transmission density is high, the CPU 100 may determine wrongly that the patch marks are not formed, even if the patch marks are formed actually.

In the present embodiment, if the potential of the first sensor 91 has exceeded the threshold value R1, the development bias DbB is reduced in order to increase the above difference. Specially, it is preferable that the amount of the infrared beam reflected by the correction patch marks formed with a toner other than the black toner and detected by the second sensor 92 falls in a region indicated by two-dot dashed lines in FIG. 9B. The region includes a density corresponding to the lowest amount of the infrared beam reflected by the correction patch marks formed with a toner other than the black toner and detected by the second sensor 92. If the development bias DbB is reduced as described above, the above difference becomes large. Therefore, accuracy of detecting the positions of the correction patch marks in Step SB can be increased by setting the adjustment parameter RB2, that is, the threshold value R2 to a large value. Thus, in this embodiment, the influence of the diffusion-reflected light to the detection of the correction patch marks can be suppressed, to achieve appropriate correction of the displacement of different-color images. Then, Step S6 and the subsequent steps are performed.

If the correction coefficient P1 is smaller than Pmin (No in S13), the correction coefficient P1 is set to initial value P0 in Step S15, terminating the process (Step S10) of displaying an error message. In other words, the displacement of different-color images is not corrected if the amount of the diffusion-reflected light is excessively large.

Further, in the present embodiment, in Step S6, the threshold value R1 is set to potentials corresponding to the light amount higher than the amount of diffusion-reflected light that occurs due to the unevenness at the surface of the conveying belt 33. The threshold value R2 is set to potentials corresponding to the light amount smaller than the amount of mirror-reflected light that occurs due to the unevenness at the surface of the conveying belt 33. Hence, the influence of the diffusion-reflected light can more be suppressed, thereby to correct the displacement of different-color images more appropriately. Moreover, the threshold values R1 and R2 are set (Yes in S61) when the variable RN indicating the number of the automatic registration has been performed since the threshold values have been set in Step S6 in the latest time has exceeded the predetermined value RN_S (Yes in S2) Thus, the threshold values R1 and R2 can be set again at the time when the surface state of the conveying belt 33 may change.

The more appropriate threshold values R1 and R2, the more reliably can the influence of the diffusion reflected light be suppressed.

5. Other Embodiments of the Invention

Although the present invention has been described with respect to specific embodiments, it will be appreciated by one skilled in the art that a variety of changes may be made without departing from the scope of the invention.

Figure 10:
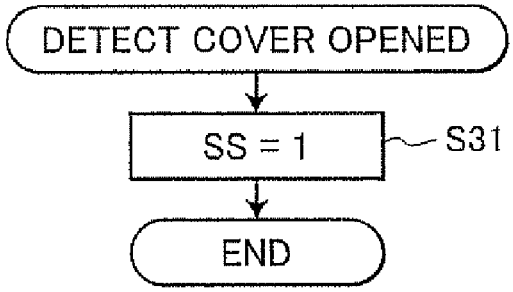
FIG. 10 is a flowchart explaining an interruption process that is performed when a cover is opened.

For example, the Flag SS is set to 1 not only if variable RN has reached RN_S (Yes in S2), but also in such a case as will be described. FIG. 10 is a flowchart explaining the interruption process that is performed when the cover sensor 110 detects that the upper cover of the housing 3 has been opened. The interruption process is terminated when flag SS is set to 1 in Step S31.

Figure 11:
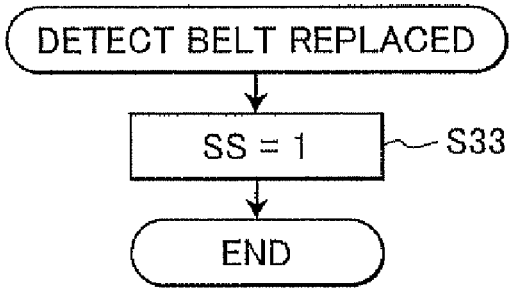
FIG. 11 is a flowchart explaining an interruption process that is performed when a belt is replaced.

FIG. 11 is a flowchart explaining the interruption process that is performed when the belt sensor 120 detects the replacement of the conveying belt 33. This interruption process is terminated, too, when flag SS is set to 1 in Step S33.

Figure 12:
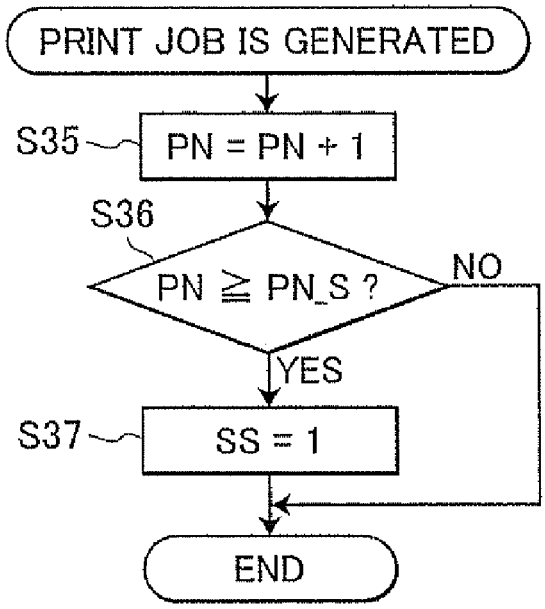
FIG. 12 is a flowchart explaining an interruption process that is performed when a print job is generated.

FIG. 12 is a flowchart explaining the interruption process that is performed every time a print job is generated and the image-forming unit 10 therefore forms an image on a recording sheet. As shown in FIG. 10, variable PN indicating the number of sheets printed and reset to 0 at the time of setting the threshold value (refer to Step S6) is incremented by one in Step S35. In the next step, i.e., Step S36, whether variable PN has reached or exceeded a preset value PN S. If PN<PN_S (if No in S36), the interruption process is terminated. If PN≧PN S (if yes in S36), the operation goes to Step S37. In Step S37, flag SS is set to 1 and the process is terminated. Note that if the flag SS=1 (Yes in S61), in Step S62, the variables PN are reset to 0.

Thus, the more appropriate threshold values R1 and R2, the more reliably can the influence of the diffusion reflected light be suppressed.

Further, various parameters can be used as parameter for adjusting the image density in the process of forming correction patch marks. The correction patch marks may be adjusted in terms of density, by changing the transfer bias (transfer voltage) the intensity of the light applied to the photosensitive drums 71, or the exposure time. In this case, too, images can be formed in the same way as in the above-described embodiment, only if the transfer bias, the intensity of exposure light or the exposure time is set to an appropriate value. If the transfer bias is corrected, however, the toner not transferred may remain on the photosensitive drums 71 and may eventually be degraded. Such a problem would not arise in this invention, because the development bias is corrected as in the embodiment described above. Hence, the toners can be used over a long period of time.

In the embodiment described above, development bias DbB set in Step S5 for automatic registration is used for all toners of different colors. Instead, a bias of the same value for forming images on recording sheets may be used to form a black-correction patch mark on the conveying belt 33, and development bias DbB may be used to form yellow-, magenta- and cyan-correction patch marks.

The embodiment described above is a laser printer of the direct tandem type. The invention is not limited to laser printers of this type, nevertheless. The invention may be applied to an electro-photographic image-forming device of, for example, a four-cycle type. Further, the invention is not limited to an device in which correction patch marks are formed on the transfer belt 33. Rather, correction patch marks may be formed on members (e.g., intermediate transfer members or photosensitive drums) that rotate as the image-forming unit 10 operates.

What is claimed is:

1. An image-forming device comprising:

a moving member having a surface movable;

a patch mark-forming unit configured to form a first patch mark at a first density on the surface;

a light emitting unit that emits an incident light onto the surface moving, at an incident angle for the surface, the incident light reflected by the surface being divided into a mirror-reflected light and a diffusion-reflected light on the surface, the mirror-reflected light being reflected by the surface at a reflected angle equal to the incident angle;

a first detecting unit configured to detect an amount of the diffusion-reflected light;

a density controlling unit configured to control the patch mark forming unit to reform a second patch mark at a second density weaker than the first density if the amount detected by the first detecting unit is larger than a threshold;

a second detecting unit configured to detect an amount of the mirror-reflected light reflected by the surface on which the second patch mark has been reformed;

a position calculating unit configured to calculate, based on the amount detected by the second detecting unit, a position on the surface at which an image should be formed; and an image-forming unit configured to form an image at the position.

2. The image-forming device according to claim 1, further comprising:

a moving unit configured to move the moving member during a predetermined period; and a threshold setting unit configured to set the threshold to a value higher than a maximum value of the amount detected by the first detecting unit during the predetermined period.

3. The image-forming device according to claim 1, further comprising a forming times detecting unit configured to detect times the patch marks has been formed, wherein the threshold setting unit sets the threshold when the times has exceeded a predetermined times.

4. The image-forming device according to claim 1, further comprising a recording number detecting unit configured to detect number of recording mediums on which the image-forming unit forms images, wherein the threshold setting unit sets the threshold when the number has exceeded a predetermined number.

5. The image-forming device according to claim 1, further comprising:

a casing in which the moving member is mounted and having a cover openable to detach the moving member from the casing, wherein the threshold setting unit sets the threshold when the cover has been opened.

6. The image-forming device according to claim 1, further comprising a casing in which the moving member is mounted, wherein the threshold setting unit sets the threshold when the moving member is detached from the casing.

7. The image-forming device according to claim 1, wherein the patch mark-forming unit comprises:

a photosensitive member having a photosensitive surface;

a scanning member that scans the photosensitive surface to form a latent image thereon; and a developing member that applies a developing bias on the photosensitive member to supply a charged toner on the latent image, wherein the patch mark-forming unit reforms the second patch mark by changing the developing bias.

8. The image-forming device according to claim 1, wherein the patch mark-forming unit comprises:

a photosensitive member having a photosensitive surface;

a scanning member that scans the photosensitive surface at an intensity during a period to form a latent image thereon; and a developing member that applies a developing bias on the photosensitive member to supply a charged toner on the latent image, wherein the patch mark-forming unit reforms the second patch mark by changing the intensity.

9. The image-forming device according to claim 1, wherein the patch mark-forming unit comprises:

a photosensitive member having a photosensitive surface;

a scanning member that scans the photosensitive surface at an intensity during a period to form a latent image thereon; and a developing member that applies a developing bias on the photosensitive member to supply a charged toner on the latent image, wherein the patch mark-forming unit reforms the second patch mark by changing the period.

10. The image-forming device according to claim 1, wherein the second density is a density corresponding to the lowest amount among amounts detected by the second detecting unit when changing a density of a patch mark formed with a toner other than black toner.

11. An image displacement correcting method comprising:

forming a first patch mark at a first density on a surface;

emitting an incident light onto the surface moving, at an incident angle for the surface, the incident light reflected by the surface being divided into a mirror-reflected light and a diffusion-reflected light on the surface, the mirror-reflected light being reflected by the surface at a reflected angle equal to the incident angle;

detecting an amount of the diffusion-reflected light;

reforming a second patch mark at a second density weaker than the first density if the detected amount of the diffusion-reflected light is larger than a threshold;

detecting an amount of the mirror-reflected light reflected by the surface on which the second patch mark has been reformed;

calculating, based on the detected amount of the mirror-reflected light, a position on the surface at which an image should be formed; and forming an image at the position.

* * * * *